United States Patent [19]

Dixon et al.

[11] Patent Number: 4,533,336

[45] Date of Patent: Aug. 6, 1985

[54] LOCKING TOY VEHICLE

[76] Inventors: John Dixon; Peter Manning, both of Hayne Barton, Shillingford, Tiverton, Devon, England

[21] Appl. No.: 490,235

[22] Filed: Apr. 29, 1983

[51] Int. Cl.[3] ..... A63H 17/00

[52] U.S. Cl. ..... 446/465; 312/219; 446/489

[58] Field of Search ..... 46/201, 2; 312/219; 446/431, 465, 489

[56] References Cited

U.S. PATENT DOCUMENTS

| | | | |
|---|---|---|---|
| 382,758 | 5/1888 | Dutemple | 63/29 R |
| 410,378 | 9/1889 | Rodeheaver | 312/219 |
| 2,078,767 | 4/1937 | Marx | 46/2 |
| 4,040,204 | 8/1977 | Zucker | 46/2 |

FOREIGN PATENT DOCUMENTS

| | | | |
|---|---|---|---|
| 1439649 | 6/1976 | United Kingdom | 312/219 |

*Primary Examiner*—F. Barry Shay

*Attorney, Agent, or Firm*—Kenyon and Kenyon

[57] ABSTRACT

A toy vehicle has hinged and lockable doors, trunk lid, and hood, each with an internal U-shaped shackle, clevis, or claw projecting inwardly. A single locking plate is slidably positioned inside the vehicle. The plate has an integral sliding bolt at each position which is adjacent a shackle, clevis, or claw. The internal hub of each wheel has an integral, cam shaped member formed thereon to be captured or released by detents on the locking plate. A key fits through a key hole in the bottom of the vehicle in order to slide the plate forward or aft, as the key turns. As it so slides, a bolt or detent on the plate slides through or out of each shackle, clevis; or claw and engages or disengages the cam members, thereby locking or unlocking the doors and wheels.

14 Claims, 2 Drawing Figures

LOCKING TOY VEHICLE

Figure 1:
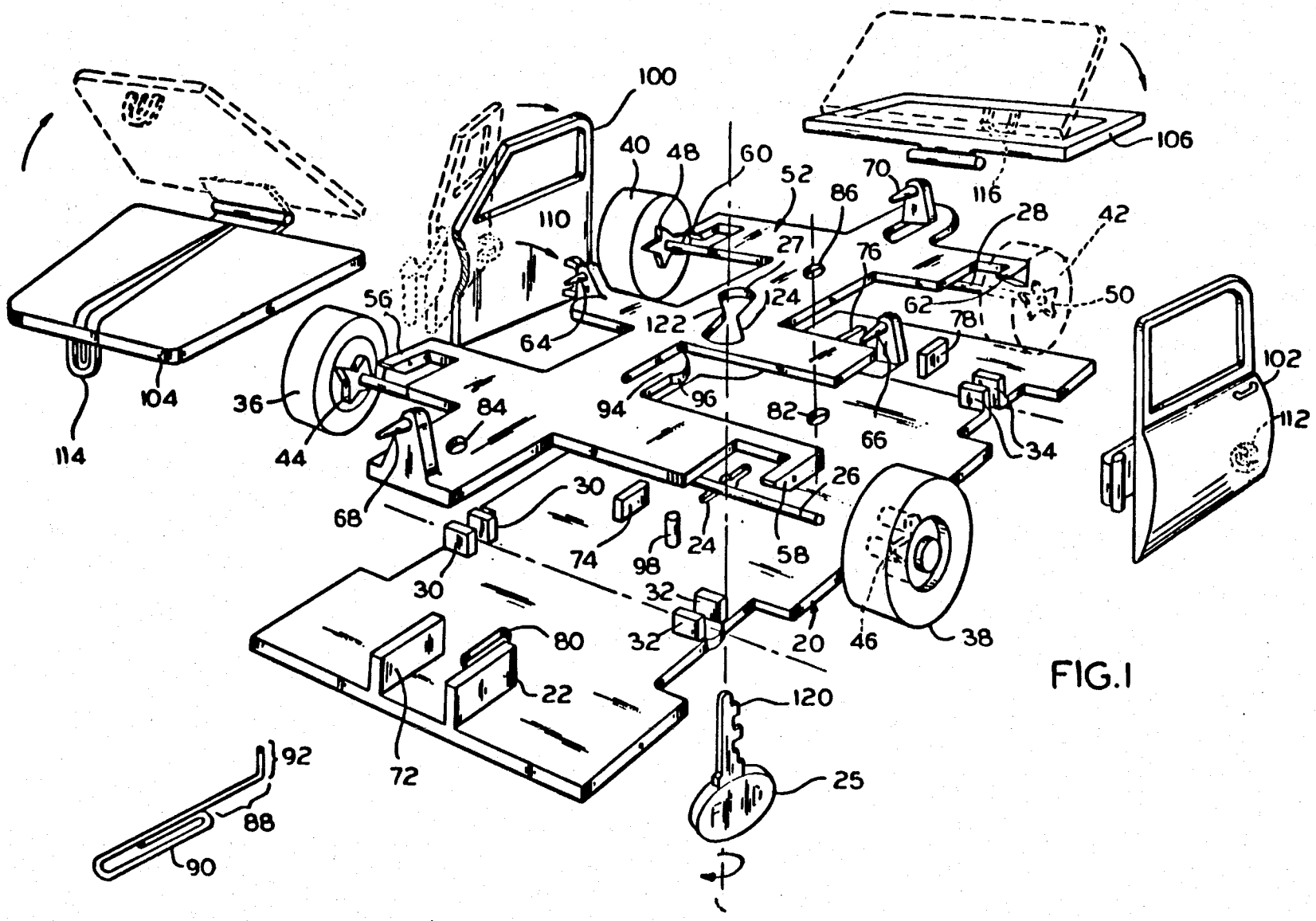

This invention relates to toy vehicles, and more particularly, to toy vehicles which appear to lock their doors, wheels, etc., responsive to a use of a key, in simulation of the locking of a real vehicle.

The invention relates to a class of toys which was once known as "die-cast vehicles." These toys are very small life-like replicas of vehicles and are characterized by an abundance of appearance details, which are copied from or modeled after the details on a specific real vehicle. Thus, each toy vehicle is a recognizable replica of a well known automobile, truck, etc. These toy vehicles are becoming more realistic as time goes on because advancing technology improves the ability to make greater realism, as by giving action to the toys.

To a child, realism is often the ability to do things which a parent or adult does, with the full sized vehicle. One of those things is to park a vehicle, set the brake, and lock the doors. Therefore, to a child, there is a greater realism, if a toy vehicle can be locked in a similar manner.

On the other hand, there is usually a substantial cost associated with providing so many details and such diverse functions. From the viewpoint of the manufacturers, it is desirable to provide a universal design of parts and construction which can easily be modified, at low cost, to convert the end product toy into a simulation of any one of many vehicles. Thus, it is desirable for one set of dies, with a few modifying parts, to make any one of, say 6–12 different makes and models of automobiles. Further, it is desirable for the toys to have features that lend themselves to mass advertising or other marketing promotions. Thus, for example, a feature, such as a secret way of unlocking the car without a key, has great sales appeal.

Therefore, there is a need and an opportunity for providing an even more realistic toy vehicle by making it operate in a more realistic manner. Accordingly, an object of the invention is to provide new and improved toy vehicles, having greater realism. Here, an object is to provide toy vehicles having doors, hood, trunk, wheels, etc. which may be locked or unlocked by a key.

Another object is to provide a toy vehicle of the described type which may still be locked and unlocked, manually and in a "secret" manner, especially if a key is lost.

Yet another object is to provide a vehicle having a few relatively low cost, simple, and trouble free parts, which accomplish these and other objects.

In keeping with an aspect of the invention, these and other objects are accomplished by providing a toy vehicle having hinged and lockable doors, trunk lid, and hood, each with an internal U-shaped shackle, clevis or claw projecting inwardly. A single locking plate is slidably positioned inside the vehicle. The plate has an integral sliding bolt at each position which is adjacent a shackle, clevis or claw. The internal hub of each wheel has an integral, cam-like (here star shaped) member formed thereon to be captured or released by detents on the locking plate. A key fits through a key hole in the bottom of the vehicle in order to slide the plate forward or aft, as the key turns. As it so slides, a bolt or detent on the plate slides through or out of each shackle or clevis and engages or disengages the star members, thereby locking or unlocking the doors, wheels and other components.

Figure 2:
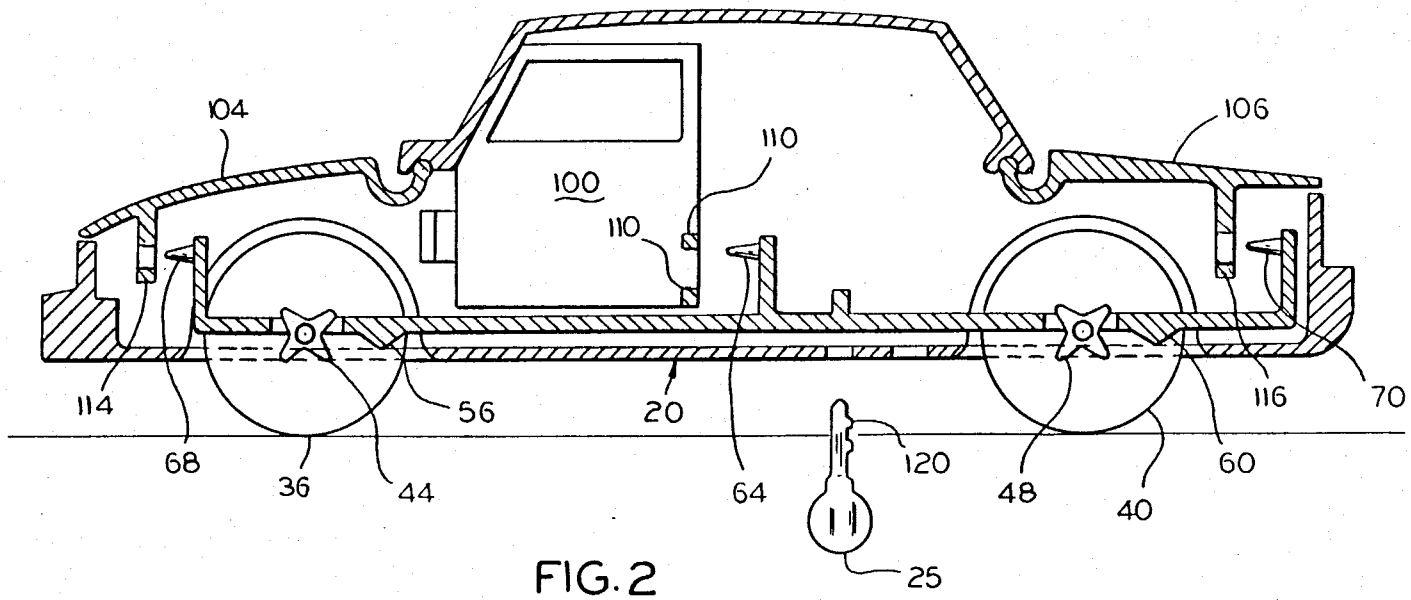

A preferred embodiment is shown in the attached drawings, wherein:

FIG. 1 is an exploded view of pertinent parts of the inventive vehicle (less the body shell); and FIG. 2 is a cross-sectional view of the vehicle of FIG. 1 (including the body shell) showing the inventive mechanism in an unlocked condition.

In FIGS. 1, 2, there is a chassis 20 made of any suitable material and having a plurality of upstanding embossments integrally formed thereon (as at 22 in FIG. 1, for example) and a key hole 24 formed therein. A key 25 fits through the key hole 24 to engage a cam area 27 in a sliding lock member in order to move it forward or aft. The embossments (such as 22) provide either anchor points for securing parts thereto or guideways for enabling the sliding lock member controlled by key 25 to slide back and forth in a reliable and non-binding manner.

Front and rear axles 26, 28 (FIG. 1) are, respectively, captured between two pairs of embossments 30, 32 and 34 (and a matching pair, not visible in FIG. 1). The four wheels 36, 38, 40, 42 fit over and may or may not turn with the two axles 26, 28.

Integrally formed on the inside of each of the wheels is a star shaped member 44, 46, 48, 50. If the star member 44, for example, is restrained against rotation, the wheel 36 cannot turn. Likewise, if any other of the star members is so restrained, its associated wheel cannot turn, either.

The sliding lock member 52 has a generally free shape which adapts it to fit within and slide fore and aft between the internal confines of a body shell (seen in FIG. 2). The important feature for this sliding lock member 52 is that it should support a locking device at each of the various points on the vehicle which is adjacent a body part that is to be locked.

Thus, to lock the wheels, the sliding lock member 52 has four detents 56, 58, 60, 62 which are positioned adjacent each of the star shaped members 44–50. If detent 56, for example, is jammed into the space between adjacent arms on the star member 44, the wheel 36 cannot rotate. However, if the detent 56 is retracted away from the star member, the wheel 36 can turn freely.

The sliding lock member 52 also carrys a bolt for engaging the shackle or clevis on every item on the vehicle which is to be locked. Since this is assumed to be a two door car, there are two bolts 64, 66 for locking the two doors. Bolt 68 locks the hood, and bolt 20 locks the trunk lid. If anything else is to be locked, a bolt would also be provided for it. For example, on four door cars, there would be bolts, similar to bolts 64, 66, adjacent rear door position. If there was a sun roof, there would be a bolt near it.

The sliding lock member 52 fits between guideways formed on the chassis 20 by the various embossments. For example, a forward part of panel 52 fits between embossments 22, 72. The plate 52 itself is vertically captured in any suitable manner. For example, seats, not shown, are snapped into the body shell and then the body shell is secured to the chassis 20. Thus, the sliding lock member 52 may slide back and forth between the top of the chassis 20 and the bottom of the seat.

First and second holes 80, 82 are formed in the chassis 20 and under mating holes 84, 86 in the sliding lock member 52.

In one embodiment, the chassis 20 may be made of one color material and the sliding lock member 52 may be made of another color of material. Therefore, when the lock member 52 is in one position (say the locked position), it may be seen through hole 82. When the lock member is in the other position (say the unlocked position), the two holes 82, 86 are aligned and the sliding lock member 52 is not visible. From the child's point of view, hole 82 is red, for example, when the vehicle is locked and black when it is unlocked.

The front chassis hole 80 is an elongated slot that it is positioned under hole 84 in both the locked and the unlocked position. Therefore, if the child loses the key 25, he can put something through the slot 80, hook the hole 84, and slide the lock member 52 back and forth between the two positions. The invention contemplates having the child straighten one part 88 of a paper clip 90, and then to form a hook 92 so that he can make his own key, if he loses the original keys. Thus, to slide the lock member 52 back and forth, he merely hooks hole 84 through slot 80 and pulls it in the proper direction. The "secret" way of opening the vehicle is a feature which appeals to a child.

The sliding lock member 52 includes a cantilever arm 94 having a latch 96 formed somewhat perpendicularly on the end. The latch 96 may be caught behind or released from the post 98, by sliding member 52 back and forth. Therefore, when the member 52 is moved to either the locked or the unlocked position, it does not thereafter move therefrom unless urged to do so with enough force to flex the cantilever beam 94.

The movable parts (doors 100, 102, hood 104, and trunk lid 106) are shown in opened (dashed lines) and closed (solid lines) positions. Each of the parts has a U-shaped shackle or clevis 110, 112, 114, 116 thereon. When the bolts 64, 66 slide forward or aft, they slide through or out of shackles 110, 112. When the bolts 68, 70 slide forward or aft, they slide into or out of shackles 114, 116. Likewise, any other parts of the vehicle may be locked or unlocked.

The operation of the toy vehicle should now be apparent. The key is inserted through key hole 24 and into camming area 27. As the key 25 is rotated clockwise, as viewed, a flag-like member 120 engages a cam face 122 to push the sliding lock member 52 in a forward or locking direction. When the key 25 is again put into the key hole and rotated in a counter clockwise direction, the flag-like member 120 engages cam face 124 to push the sliding lock member 52 in an aft or unlocking direction. Since the sliding lock member 52 and the chassis 20 are contrasting colors, it is easy to know which way to insert the key 25 into the key hole 24.

Those who are skilled in the art will readily perceive how to modify the invention. Therefore, the appended claims are to be construed to cover all equivalent structures which fall within the true scope and spirit of the invention.

What is claimed is:

1. A toy vehicle having a body with at least one part mounted thereon in movable relation thereto, a shackle on the interior of said part and projecting into the interior of said vehicle, a sliding lock member supported and positioned inside said body and slidable relative thereto to move between two positions, key means, means for permitting insertion of said key means into said body at a point which engages said sliding lock member is selectively move said lock member between said two positions responsive to a rotation of said key means, and bolt means on said sliding lock member for engaging said shackle in one of said two positions and disengaging said shackle in the other of said two positions;

wherein said at least one part mounted on said body in movable relation thereto includes a plurality of hinged body panels, each of said panels including a shackle, and a bolt means on said sliding lock member for engaging each of said shackles wherein said sliding lock member is in said one position for engaging each of said shackles.

2. The toy of claim 1 wherein said hinged panels include at least a door, a hood, and a trunk lid.

3. The toy of claim 2 and chassis means at the bottom of said vehicle, at least one elongated opening formed in said chassis means at a location under said sliding lock member and a control hole formed in said sliding lock member in a position which is over said elongated opening when said sliding lock member is in each of said two positions.

4. The toy of claim 2 and a cantilever spring means having a latching end integrally fromed on said sliding lock member, and means responsive to a movement of said sliding lock member between said two positions for engaging said latching end, whereby said sliding lock member cannot move out of either of said two positions unless urged to move with a force which is great enough to flex said cantilever spring means.

5. The toy of claim 1 and chassis means at the bottom of said vehicle, at least one elongated opening formed in said chassis means at a location under said sliding lock member and a control hole formed in said sliding lock member in a position which is over said elongated opening when said sliding lock member is in each of said two positions.

6. The toy of claim 1 wherein said sliding lock member and said chassis means are contrasting colors and a first hole member formed in said sliding lock member aligned with a second hole formed in said chassis member when said sliding lock member is in only one of said two positions, whereby the second hole appears to change color as said sliding lock member moves between said two positions.

7. The toy of claim 1 and a cantilever spring means having a latching end integrally formed on said sliding lock member, and means responsive to a movement of said sliding lock member between said two positions for engaging said latching end, whereby said sliding lock member cannot move out of either of said two positions unless urged to move with a force which is great enough to flex said cantilever spring means.

8. A toy vehicle having a body with at least one part mounted thereon in movable relation thereto, a shackle on the interior of said part and projecting into the interior of said vehicle a sliding lock member supported and positioned inside said body and slidable relative thereto to move between two positions, key means, means for permitting insertion of said key means into said body at a point which engages said sliding lock member to selectively move said lock member between said two positions responsive to a rotation of said key means, and bolt means on said sliding lock member for engaging said shackle in one of said two positions and disengaging said shackle in the other of said two positions;

wherein said at least one part mounted on said body in movable relation thereto includes a plurality of vehicle wheels rotatably mounted on said body, each of said wheels including an internal cam wheel, and detent means on said sliding lock member adjacent each of said cam wheels for engaging said cam wheels to prevent rotation of said wheels when said sliding lock member is in said one position.

9. The toy of claim 8 and chassis means at the bottom of said vehicle, at least one elongated opening formed in said chassis means at a location under said sliding lock member and a control hole formed in said sliding lock member in a position which is over said elongated opening when said sliding lock member is in each of said two positions.

10. The toy of claim 8 wherein said sliding lock member and said chassis means are contrasting colors and a first hole member formed in said sliding lock member aligned with a second hole formed in said chassis member when said sliding lock member is in only one of said two positions, whereby the second hole appears to change color as said sliding lock member moves between said two positions.

11. The toy of claim 8 and a cantilever spring means having a latching end integrally formed on said sliding lock member, and means responsive to a movement of said sliding lock member between said two positions for engaging said latching end, whereby said sliding lock member cannot move out of either of said two positions unless urged to move with a force which is great enough to flex said cantilever spring means.

12. A toy vehicle having a body with at least one part mounted thereon in movable relation thereto, a shackle on the interior of said part and projecting into the interior of said vehicle, a sliding lock member supported and positioned inside said body and slidable relative thereto to move between two positions, key means, means for permitting insertion of said key means into said body at a point which engages said sliding lock member to selectively move said lock member between said two positions responsive to a rotation of said key means, bolt means on said sliding lock member for engaging said shackle in one of said two positions and disengaging said shackle in the other of said two positions, and chassis means at the bottom of said vehicle, at least one elongated opening formed in said chassis means at a location under said sliding lock member and a control hole formed in said sliding lock member in a position which is over said elongated opening when said sliding lock member is in each of said two positions.

13. The toy of claim 12 wherein said sliding lock member and said chassis means are contrasting colors and a first hole member formed in said sliding lock member aligned with a second hole formed in said chassis member when said sliding lock member is in only one of said two positions, whereby the second hole appears to change color as said sliding lock member moves between said two positions.

14. A toy vehicle having a body with at least one part mounted thereon in movable relation thereto, a shackle on the interior of said part and projecting into the interior of said vehicle, a sliding lock member supported and positioned inside said body and slidable relative thereto to move between two positions, key means, means for permitting insertion of said key means into said body at a point which engages said sliding lock member to selectively move said lock member between said two positions responsive to a rotation of said key means, bolt means on said sliding lock member for engaging said shackle in one of said two positions and disengaging said shackle in the other of said two positions, and a cantilever spring means having a latching end integrally formed on said sliding lock member, and means resposive to a movement of said sliding lock member between said two positions for engaging said latching end, whereby said sliding lock member cannot move out of either of said two positions unless urged to move with a force which is great enough to flex said cantilever spring means.

* * * * *